US007540568B2

(12) United States Patent
Behrens et al.

(10) Patent No.: US 7,540,568 B2
(45) Date of Patent: Jun. 2, 2009

(54) THREE-DIMENSIONAL UNFILLED FURNITURE

(75) Inventors: Philip Behrens, Winston-Salem, NC (US); Donald L. Bottemiller, Plymouth, MN (US)

(73) Assignee: Natura Design Inc., Winston-Salem, NC (US)

( * ) Notice: Subject to any disclaimer, the term of this patent is extended or adjusted under 35 U.S.C. 154(b) by 0 days.

(21) Appl. No.: 11/841,346

(22) Filed: Aug. 20, 2007

(65) Prior Publication Data

US 2009/0051207 A1 Feb. 26, 2009

(51) Int. Cl.

| | |
|---|---|
| ***A47C 7/02*** | (2006.01) |
| ***A47C 5/06*** | (2006.01) |
| ***A47C 5/10*** | (2006.01) |
| ***A47C 5/12*** | (2006.01) |
| ***A47C 4/28*** | (2006.01) |

(52) U.S. Cl. ..... 297/445.1; 297/440.1; 297/440.11; 297/440.14; 297/440.24; 297/447.1; 297/448.1; 297/450.1; 297/452.13; 297/452.2; 297/452.56; 297/42; 297/45

(58) Field of Classification Search ..... 297/440.1, 297/440.14, 440.24, 452.2, 449.1, 446.1, 297/447.3, 445.1, 447.1, 448.1, 450.1, 451.8, 297/451.13, 45, 452.13, 452.56, 440.11, 297/42

See application file for complete search history.

(56) References Cited

U.S. PATENT DOCUMENTS

| | | | | | |
|---|---|---|---|---|---|
| 1,103,646 | A | | 7/1914 | Baddeley | |
| 1,422,915 | A | * | 7/1922 | Benson et al. | 297/440.24 X |
| 1,879,724 | A | * | 9/1932 | Wolpert | 297/447.1 X |
| 1,959,696 | A | * | 5/1934 | Todd et al. | 297/452.2 X |
| 1,971,471 | A | | 8/1934 | White | |
| 2,104,818 | A | * | 1/1938 | Schjolin | 297/448.2 |
| D129,157 | S | | 8/1941 | Burst | |
| 2,333,073 | A | * | 10/1943 | Mueller | 297/440.2 X |
| D141,703 | S | * | 6/1945 | Risom | 297/450.1 X |
| 2,454,912 | A | * | 11/1948 | Cunningham | 297/447.1 X |
| D154,356 | S | * | 7/1949 | Allmand | 297/448.1 X |
| 2,512,353 | A | * | 6/1950 | Magaldino et al. | 297/440.24 X |
| 2,581,793 | A | | 1/1952 | Hill | |
| 2,644,508 | A | | 7/1953 | Weill | |
| 2,644,511 | A | | 7/1953 | Saint-Maurice | |
| 2,659,419 | A | * | 11/1953 | Waldheim et al. | 297/447.1 X |
| 2,660,228 | A | | 11/1953 | Reinhold | |
| 2,667,916 | A | * | 2/1954 | Burd | 297/448.1 |
| 2,821,245 | A | * | 1/1958 | Meneghelli | 297/452.2 X |
| 2,865,436 | A | * | 12/1958 | Thorne | 297/440.11 |
| 3,081,131 | A | * | 3/1963 | Brueder | 297/452.2 |
| 3,086,225 | A | * | 4/1963 | Fillingim | 297/440.11 X |
| 3,104,132 | A | * | 9/1963 | Entwistle | 297/440.1 |
| 3,131,971 | A | * | 5/1964 | Gunn | 297/446.2 |
| 3,182,614 | A | | 5/1965 | McLean | |
| 3,208,794 | A | * | 9/1965 | Gunn | 297/440.11 |
| 3,301,597 | A | * | 1/1967 | Bereday | 297/450.1 |
| 3,410,328 | A | | 11/1968 | Sasai | |

(Continued)

*Primary Examiner*—Rodney B White
(74) *Attorney, Agent, or Firm*—Dicke, Billig & Czaja, PLLC

(57) ABSTRACT

One aspect is a furniture piece configured for seating. The furniture piece includes first and second contours and a spreader mechanism coupled between the first and second contours. A three-dimensional cover envelope having panels in each of three-dimensions is configured over the first and second contours and the spreader mechanism thereby surrounding the contours and spreader mechanism. The cover envelope is tensioned in each panel creating a simulated cushion.

27 Claims, 8 Drawing Sheets

U.S. PATENT DOCUMENTS 3,719,389 A * 3/1973 Burton et al. ..... 297/440.24
3,985,460 A * 10/1976 Piper et al. ..... 297/452.13 X
4,097,089 A * 6/1978 Petersen ..... 297/440.1 X
4,124,251 A * 11/1978 Petersen ..... 297/448.1
4,232,899 A 11/1980 Fister, Jr.
4,234,226 A * 11/1980 Colby ..... 297/440.11 X
4,359,244 A * 11/1982 Koehm ..... 297/45 X
4,469,377 A * 9/1984 O'Rourke ..... 297/440.24 X
4,545,614 A * 10/1985 Abu-Isa et al. ..... 297/440.11 X
4,579,383 A 4/1986 Colby
4,580,840 A * 4/1986 Cunningham et al. ..... 297/452.56 X
4,602,817 A * 7/1986 Raftery ..... 297/440.1
4,674,799 A * 6/1987 Schwartz et al. ..... 297/448.1
4,684,149 A * 8/1987 Meyer ..... 297/42 X
4,711,495 A * 12/1987 Magder ..... 297/452.52
4,762,368 A * 8/1988 Schwartz et al. ..... 297/448.1
5,058,949 A * 10/1991 Von Hoffman ..... 297/45
5,094,507 A * 3/1992 Gibbs ..... 297/440.1 X
5,244,250 A * 9/1993 Nordmeyer ..... 297/45 X
5,271,422 A * 12/1993 Sorrell et al. ..... 297/45 X
5,358,263 A * 10/1994 Aldus et al. ..... 297/45 X
5,393,126 A * 2/1995 Boulva ..... 297/452.56
5,507,563 A * 4/1996 Arthur, Jr. ..... 297/452.2 X
5,533,789 A * 7/1996 McLarty et al. ..... 297/452.56 X
5,632,526 A * 5/1997 McLarty et al. ..... 297/452.56 X
5,775,779 A * 7/1998 Abu-Isa et al. ..... 297/452.56
6,050,646 A * 4/2000 Stenzel et al. ..... 297/440.11 X
6,341,822 B2 * 1/2002 Apissomian ..... 297/440.11
6,435,618 B1 * 8/2002 Kawasaki ..... 297/452.56
6,450,575 B1 * 9/2002 Liu ..... 297/440.1 X
6,591,778 B1 7/2003 Alderman
6,666,518 B2 * 12/2003 Bruschi et al. ..... 297/440.14
6,676,218 B2 * 1/2004 Fujita et al. ..... 297/452.56 X
7,240,967 B2 * 7/2007 Wade ..... 297/440.1
2002/0153757 A1 * 10/2002 Lo ..... 297/448.1
2003/0062757 A1 * 4/2003 Calvery ..... 297/440.24
2007/0007813 A1 * 1/2007 Pomeroy et al. ..... 297/440.1

* cited by examiner

THREE-DIMENSIONAL UNFILLED FURNITURE

BACKGROUND

The present invention relates furniture construction. In particular, it relates to a three-dimensional fabric envelope installed over a contoured frame.

One factor in designing casual outdoor furniture is the ability of the outdoor furniture to shed water without significant retention. Casual outdoor furniture utilizing cushions has typically suffered from water-retention issues. Some casual outdoor furniture utilizing cushions has used reticulated foam or densified polyester fiber. Such materials can shed some water in an outdoor environment. However, both of these materials do retain some amount of water. Furthermore, these materials tend to be very expensive and/or tend to be very difficult to shape into desired dimensions. For these and other reasons, there is a need for the present invention.

SUMMARY

One embodiment includes a furniture piece configured for seating. The furniture piece includes first and second contours and a spreader mechanism coupled between the first and second contours. A three-dimensional cover envelope having panels in each of three-dimensions is configured over the first and second contours and the spreader mechanism thereby surrounding the contours and spreader mechanism. The cover envelope is tensioned in each panel creating a simulated cushion.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

Figure 1:
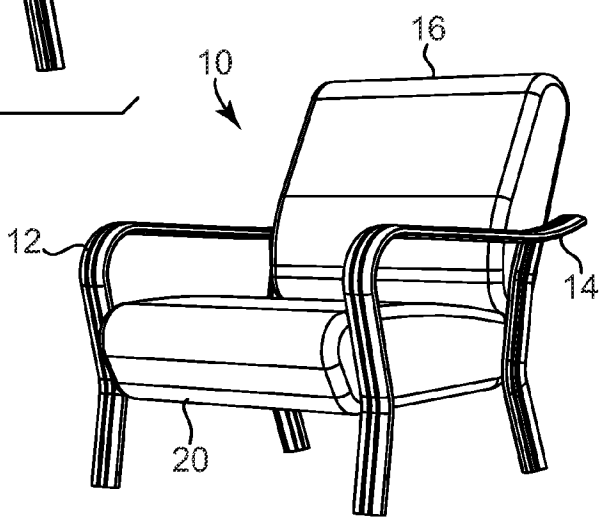
FIG. 1 illustrates a perspective view of a three-dimensional chair according to one embodiment.
Figure 2:
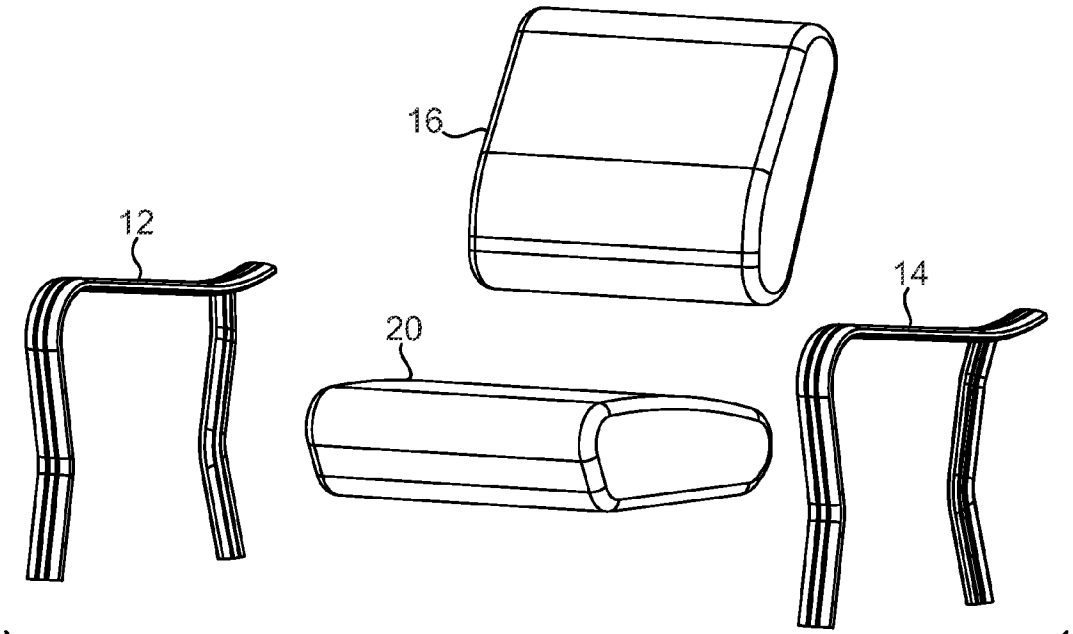
FIG. 2 illustrates an exploded view of a three-dimensional chair in accordance with one embodiment.

FIGS. 1 and 2 illustrate a chair 10 in accordance with one embodiment. Chair 10 includes first support 12, second support 14, chair back 16, and chair base 20. FIG. 1 illustrates chair 10 in perspective view, while FIG. 2 illustrates an exploded view of chair 10. In one embodiment, each of chair back 16 and chair base 20 are coupled between, and supported by, first and second supports 12 and 14. For example, one side of each chair back 16 and chair base 20 (the left side as illustrated) is fixed to first support 12, and one side of each chair back 16 and chair base 20 (the right side as illustrated) is fixed to second support 14. In this way, chair back 16 and chair base 20 are supported vertically upward from the ground on which first and second supports 12 and 14 are placed.

In one embodiment, chair back 16 and chair base 20 are each configured to have a three-dimensional volume or a "simulated cushion" shape, but are not filled with foam or other cushion material. As such, chair 10 can function well as casual outdoor furniture that easily sheds water without excess water retention, because each of its elements chair back 16 and chair base 20 remain unfilled so that it does not use foam or cushion material to form and maintain the three-dimensional volume of back 16 and base 20.

Figure 3:
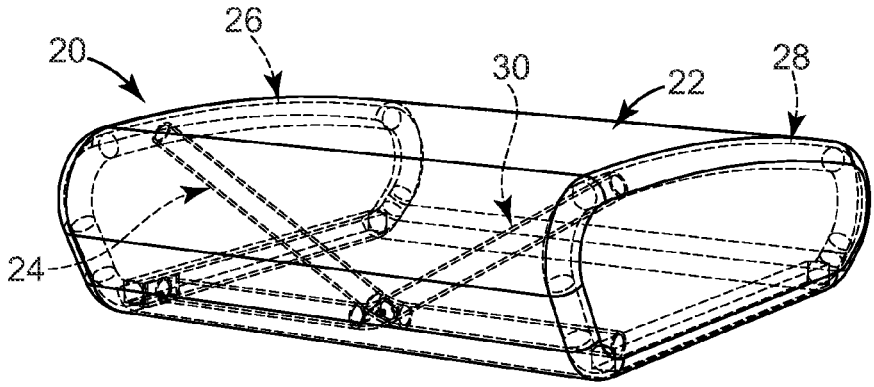
FIG. 3 illustrates a partially-ghosted three-dimensional seating structure in accordance with one embodiment.

FIG. 3 illustrates chair base 20 in accordance with one embodiment. Chair base 20 includes cover 22 and frame 24. Frame 24 includes first contour 26, second contour 28, and spreader mechanism 30. In FIG. 3, cover 22 has a three-dimensional volume shape that covers frame 24. As such, frame 24 appears in dotted lines to illustrate that it is contained within cover 22. In one embodiment, cover 22 is a fabric material that is sewn into a three-dimensional volume or envelope. In one example, cover 22 can be stretched over frame 24 thereby defining a three-dimensional base 20.

In one example, cover 22 is tensioned sufficiently by frame 24 such that the entire volume of cover 22 in under some amount of tension. In this way, base 20 is readily useable as furniture for sitting. By tensioning the entire volume of cover 22 with frame 24, base 20 provides support for a seated user, and provides some "give" as the material of cover 22 is stretched under the weight of a seated user. Unlike a chair that has fabric tensioned in only one or two panels, cover 22 is tensioned in all of its panels, thereby providing a more comfortable seating structure. In this way, it is a simulated cushion. As such, it has the shape of a traditional cushion, but is not filled with cushioned material, but instead has its entire volume placed under tension to provide a comfort for seating. Back 16 can be constructed similarly with an analogous frame and cover.

By configuring first and second contours 26 and 28 within cover 22, and then forcing them apart, cover 22 is tensioned in all of its panels, thereby providing the simulated cushion. Various embodiments are possible via which first and second contours 26 and 28 are forced and held apart within cover 22 to tension cover 22. The example of FIG. 3 illustrates a spreader mechanism 30 that accomplishes the spreading apart of first and second contours 26 and 28, but other means of spreading and holding first and second contours 26 and 28 apart to tension cover 22 are possible, including means that are outside cover 22, as will be further illustrated below.

In one embodiment, first and second contours 26 and 28 are made of any of a variety of rigid materials such as aluminum, steel, plastic, wood. As such, first and second supports 12 and 14 can be fixed to first and second contours 26 and 28 of frame 24 in order to support base 20 vertically off the floor. In one case, after cover 22 is tensioned over frame 24, first and second supports 12 and 14 can be bolted to frame 24. Back 16 can be similarly bolted to first and second supports 12 and 14 by its frame. Accordingly, in one embodiment, neither back 16 nor base 20 use first or second supports 12 or 14 to tension cover 22. Instead, frame 24, which is independent of supporting back 16 and base 20 vertically off the floor, is used to tension cover 22.

Figure 4:
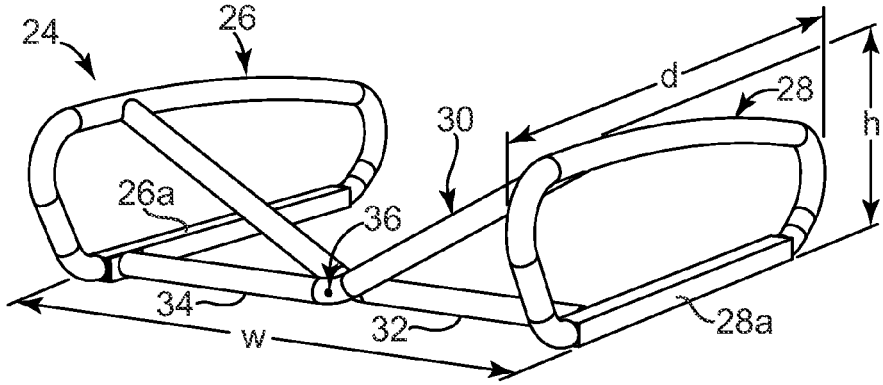
FIG. 4 illustrates a frame structure in accordance with one embodiment.

FIG. 4 illustrates frame 24 in accordance with one embodiment. In one example, frame 24 includes first contour 26, second contour 28, and spreader mechanism 30. In one example, spread mechanism 30 includes the first leg 32 and the second leg 34. In one example first and second legs 32 and 34 are coupled between first and second contours 26 and 28 and are pivotally coupled together at pivot 36. In one example, first and second contours 26 and 28 respectively include first and second connectors 26*a* and 28*a*, which can be used to secure cover 22, as will be further explained below.

In one embodiment, frame 24 provides a structure that places the entire volume of cover 22 in some amount of tension, once cover 22 is secured over frame 24. In one example, frame 24 provides a structure defined in three dimensions, which for ease of reference are referred to in FIG. 4 as a width (w), a height (h) and a depth (d). This width (w), height (h), and depth (d) define the volume in which cover 22 is tensioned. As such, placing a cover 22 over frame 24 creates a structure such as back 16 or base 20, which is usable as a piece of furniture, or component thereof, fully providing structure and support, without the use of cushions or foam.

In one embodiment, one end of first leg 32 is secured to the top of first contour 26 and one end of second leg 34 is secured to the top of second contour 28. For example, these ends of first and second legs 32 and 34 could be welded to the respective tops of first and second contours 26 and 28. The opposite ends of first and second legs 32 and 34 are then secured to the respective bottoms of second and first contour 28 and 26, that is, one end of first leg 32 is secured to the bottom of second contour 28 and one end of second leg 34 is secured to the bottom of first contour 26. In one example, these ends coupled to the lower portion of the contours can be screwed or bolted so that they can be relatively easily detached. Also in one example, first and second legs 32 and 34 of spread mechanism 30 pivot about pivot 36, which in one example is a bolt secured through first and second legs 32 and 34.

In one embodiment, when first and second legs 32 and 34 are coupled between the top portion of first and second contours 26 and 28 and released from the lower portions, spread mechanism 30 is pivotable about pivot 36 such that first and second contours 26 and 28 move relative to each other. For instance, first and second legs 32 and 34 can be pivoted such that first and second contours 26 and 28 move closer to one another such that the overall distance that separates them in the width (w) direction of frame 24 decreases. In this way, cover 22 can be assembled over frame 24 while it is in this state of decreased distance in the width (w) direction. Then, after cover 22 is fully assembled over frame 24, first and second legs 32 and 34 can be pivoted back such that first and second contours 26 and 28 expand back out to their full distance apart in the width (w) direction, thereby tensioning the volume of cover 22. First and second legs 32 and 34 can then be secured to the lower portion of first and second contours 26 and 28, thereby locking spread mechanism 30 from further pivoting.

As such, a furniture component, such as base 20 or back 16, can be created in a reversible manner. For example, starting with frame 24 illustrated in FIG. 4, first and second legs 32 and 34 can be detached from the lower portion of first and second contours 26 and 28. Spread mechanism 30 can then be pivoted about pivot 36 such that first and second contours 26 and 28 move closer together or decrease the distance that they are separated in the width (w) direction illustrated in FIG. 4. Next, a cover having a three-dimensional volume can be placed over frame 24 while frame 24 is in this retracted state and then attached to first and second contours 26 and 28 at 26*a* and 28*a*. Then, first and second legs 32 and 34 can be pivoted back such that first and second contours 26 and 28 spread back out to their full distance in the width (w) direction so that frame is rigidly held in its fully expanded state. This will then fully tension the volume of cover 22. Finally, first and second legs 32 and 34 can then be secured back to the lower portion of first and second contours 26 and 28.

In this way, furniture such as chair 10 can be reconfigured with different covers for base 20 and back 16 in a relatively easy manner. Consequently, a damaged cover can be removed by retracting the frame via the spread mechanism, a new cover can then be placed over the retracted frame, and then the frame can be returned to its expanded state via the spread mechanism. As such, the furniture is easily repaired rather than discarded.

One skilled in the art will understand that frame 24 is one exemplary embodiment. For example, although first and second legs 32 and 34 are described as being fixed to the top portion of first and second contours 26 and 28 and releasable at the bottoms thereof, one can see that first and second legs 32 and 34 can also be fixed to the bottom portion of first and second contours 26 and 28 and releasable at the tops thereof. Other configurations of a spread mechanism 30 are also possible, as will be more fully discussed below.

Figure 5:
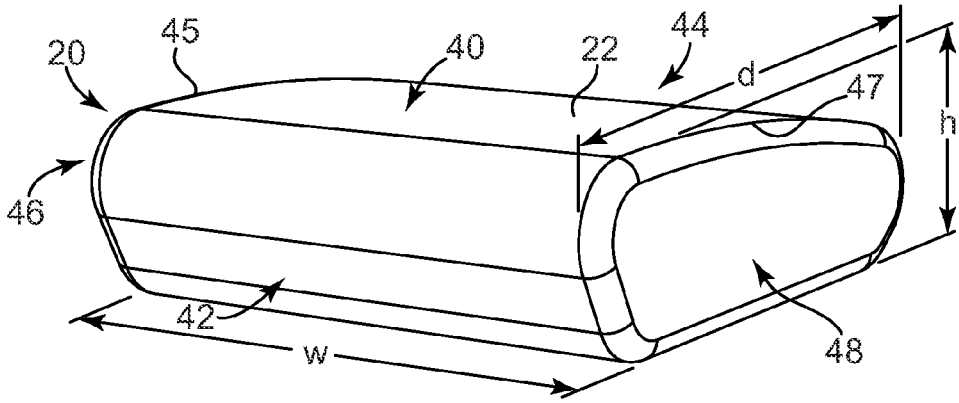
FIG. 5 illustrates a three-dimensional seating structure in accordance with one embodiment.

FIG. 5 illustrates base 20 where cover 22 is a three-dimensional fabric envelope stretched over frame 24. As such, base 20 defines a structure having a width (w), a height (h) and a depth (d), as illustrated in FIG. 5. More specifically, cover 22 has a top surface 40, a front surface 42, a back surface 44 (not visible in FIG. 5, but illustrated in FIG. 3 where cover 22 is partially ghosted), and first and second side surfaces 46 and 48 (first side surface 46 not visible in FIG. 5, but illustrated in FIG. 3 where cover 22 is partially ghosted). Top surface 40 has dimensions in the width (w) and depth (d) directions in the illustration of FIG. 5; front and back surfaces 42 and 44 have dimensions in the width (w) and height (h) directions in the illustration of FIG. 5; and first and second side surfaces 46 and 48 have dimensions in the depth (d) and height (h) directions in the illustration of FIG. 5.

Each of these two-dimensional surfaces 40, 42, 44, 46, and 48 combine to form the three-dimensional volume or envelope of cover 22 that forms base 20. Each of the first side 46, second side 48, front 42, back 44 and top 40 surfaces are tensioned to create the tensioned envelope of cover 22 and base 20, thereby forming the simulated cushion. In one example, only these five surfaces, first side 46, second side 48, front 42, back 44 and top 40, define the volume or envelope for cover 22. In other embodiments, a sixth surface, or a "bottom" surface could also be added to close the envelope created by the other five surfaces. This sixth or bottom surface could be optionally tensioned.

It is the tensioning of each of first side 46, second side 48, front 42, back 44 and top 40 surfaces of cover 22 that forms the simulated cushion. For instance, if only top surface 40 and first and second sides 46 and 48 were tensioned without tensioning front and back 42 and 44, a simulated cushion would not be created. Also, if sides 46 and 48 or front and back 42 and 44 are too short, they will not provide enough volume to give the cushioned effect of the simulated cushion once under tension. As such, cover 22 includes each of first side 46, second side 48, front 42, back 44 and top 40 surfaces under tension, and each of the surfaces around top surface 40 has sufficient height to provide the volume needed to create the tensioned simulated cushion.

In one embodiment, cover 22 is fabric that is sewn into a three-dimensional shape having two sides, a front, a back and a top. In one example, cover 22 is symmetrical about a midplane that runs vertically on the page dividing base 20 in half. A single piece of fabric can be used to form front surface 42, top surface 40 and back surface 44. The single piece can be folded or curved down in the front and back of top surface 40 to form front and back surfaces 42 and 44. First and second side surfaces 46 and 48 are then sewn to either side of this single piece of fabric, which makes up front surface 42, top surface 40 and back surface 44. Specifically, first and second side surfaces 46 and 48 are sewn along or near lines 45 and 47, respectively, in order to form the three-dimensional shape of cover 22.

First and second contours 26 and 28 then engage opposing sides of cover 22, along the lines 45 and 47 where first and second side surfaces 46 and 48 are sewn to front surface 42, top surface 40 and back surface 44. Once within cover 22, first and second contours 26 and 28 are tensioned with spread mechanism 30 to create base 20. In one embodiment, the entire frame 24, including contours 26 and 28 and spread mechanism 30, is contained within cover 22 so that no portion of it is visible. In other embodiments described below, structure outside cover 22 holds contours apart. In either case, the simulated cushion of base 20 appears as if it is a fully cushioned seat.

In one example, a bottom panel can be added to completely cover frame 24. For example, after cover 22 is added over frame 24 and it is spread to fully tension cover 22, a bottom piece can then be added directly across from top surface 40 to fully enclose frame 24. In one case, a bottom piece can be glued across first side 46, second side 48, front 42, and back 44. In another example, Velcro could be used to secure it in place. Other means of connection are also possible.

References such as "bottom", "top", "front", "back", and "sides" are used herein for ease of illustration and explanation, but one skilled in the art will understand that components of embodiments can be positioned in any number of different orientations, and the directional terminology is used for purposes of illustration only. For example, if base 20 illustrated in FIG. 5 was instead intended to be a chair back (such as chair back 16 in FIGS. 1-2), then depth (d) could be referred to instead as a "height", and height (h) could be referred to instead as a "depth". As such, first side 46 could be referred to as a top, second side 48 could be referred to as a bottom, front 42 could be referred to as a first side, back 44 could be referred to as a second side, and top 40 could be referred to as a front.

Although frame 24 is not visible in FIG. 5, some of the contours it creates in cover 22 are illustrated. For example, points of tangency from frame 24 are evident in cover 22 as top surface 40 transitions around to second side surface 48 along line 47. Specifically, a point or line of tangency is illustrated where top surface 40 engages second contour 28 (at line 47), and another can be seen where second side surface 48 engages second contour 28 (slightly below line 47). First and second contours 26 and 28, and the rest of frame 24, establish a tension in each of the two-dimensional surfaces top surface 40, front and back surfaces 42 and 44, and first and second side surfaces 46 and 48. The combination of tensioning each of these surfaces that are sewn together achieves the tensioning of the entire volume of cover 22 to form the simulated cushion.

It is the perimeter or profile of the first and second contours 26 and 28 that control the shape of base 20. By varying the dimensions of first and second contours 26 and 28, a large variety of volume shapes can be achieved for base 20. First and second contours 26 and 28 are made of any of a variety of rigid materials such as aluminum, steel, plastic, wood or various other rigid materials. In one embodiment, these materials can be covered with foam or cushion material to soften frame 24 at edge locations, such as where cover 22 transitions from its top surface 40 to one of its side surfaces 46 or 48.

Figure 6:
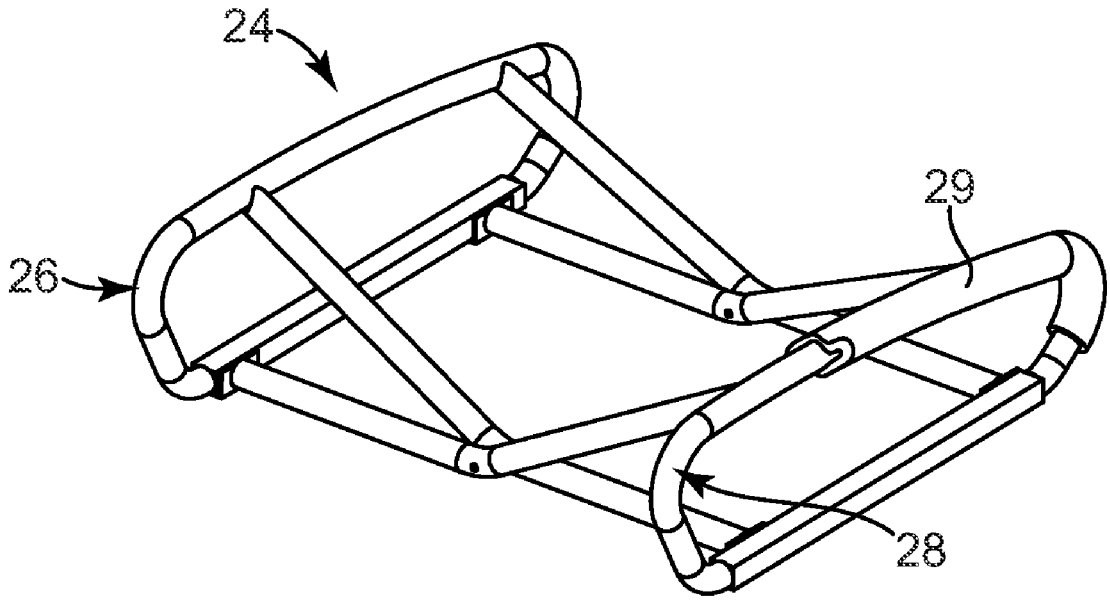
FIG. 6 illustrates a frame structure in accordance with one embodiment.

For example, FIG. 6 illustrates frame 24 with contours 26 and 28 where contour 28 is partially covered with a closed cell or reticulated foam wrap 29, which has been partially cut away for purposes of illustration. The remaining portions of first and second contours 26 and 28 can likewise be covered with wrap 29. In this way, when cover 22 is stretched over frame 24, wrap 29 provides some blunting or cushioning at the edge of contours 26 and 28, which may provide additional comfort for a user that is seated on base 20 or against back 16.

Figure 7:
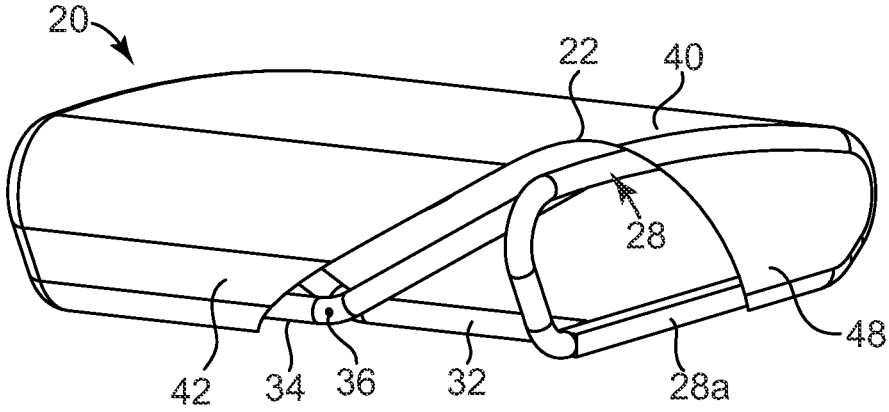
FIG. 7 illustrates a three-dimensional fabric envelope, including a partial cut-away portion, stretched over a frame in accordance with one embodiment.

FIG. 7 illustrates base 20 where cover 22 is partially cutaway to reveal a portion of frame 24. In the illustration, a portion of top surface 40, front surface 42, and second side surface 48 is cut away so that a portion of frame 24 is visible. In FIG. 7, a portion of second contour 28 is illustrated, as are portions of spread mechanism 30. Specifically, first and second legs 32 and 34 are illustrated as spread apart about pivot 36 such that first and second contours 26 and 28 are rigidly held thereby tensioning the volume of cover 22.

In one example, connector **28*a* is provided on second contour 28 to help facilitate coupling cover 22 to frame 24 at that location. In one example, connector 28*a* can be a wood portion to which cover 22 can be secured, such as by gluing, stapling or nailing. In another example, connector 28*a* can be provided with a slot into which cover 22 can be inserted and held in place with a filler strip as in conventional sling installation. One skilled in the art will understand that a variety of techniques can be used to secure cover 22 to frame 24**.

In one example, cover 22 is restrained on two locations of frame 24. FIG. 4 illustrates both first and second connectors 26*a* and 28*a* on each of first and second contours 26 and 28. In one embodiment, cover 22 is fixed along the entire surface of first and second connectors 26*a* and 28*a*. In such an embodiment, cover 22 is firmly secured to first and second contours 26 and 28 as spread mechanism 30 forces them apart, thereby further ensuring that each of the panels of cover 22 are tensioned as frame 24 is fully spread.

In FIG. 7, first and second legs 32 and 34 are illustrated spread apart about pivot 36 such that first and second contours 26 and 28 are rigidly supported, thereby tensioning the volume of cover 22 to create the simulated cushion. In one embodiment, a portion of each of first and second legs 32 and 34 lie in the bottom plane of base 20. As also illustrated in FIG. 4, the portion of first leg 32 between second contour 28 and pivot 36 and the portion of second leg 34 between pivot 36 and first contour 26 lie in the lowest plane or parallel to the bottom of base 20, such that pivot 36 is also in this lowest plane. In one case, having pivot 36 in this lowest plane ensures that when frame 24 is folded about pivot 24, first and second contours 26 and 28 will move toward each other so that cover 22 is not overstretched.

In contrast, if the pivot were located more toward the center of frame 24, when frame 24 is folded about pivot 24, first and second contours 26 and 28 will first move slightly further away from each other before moving toward each other. This widening of contours 26 and 28 can overstretched cover 22 and can be undesirable in certain materials used for cover 22.

Figure 8:
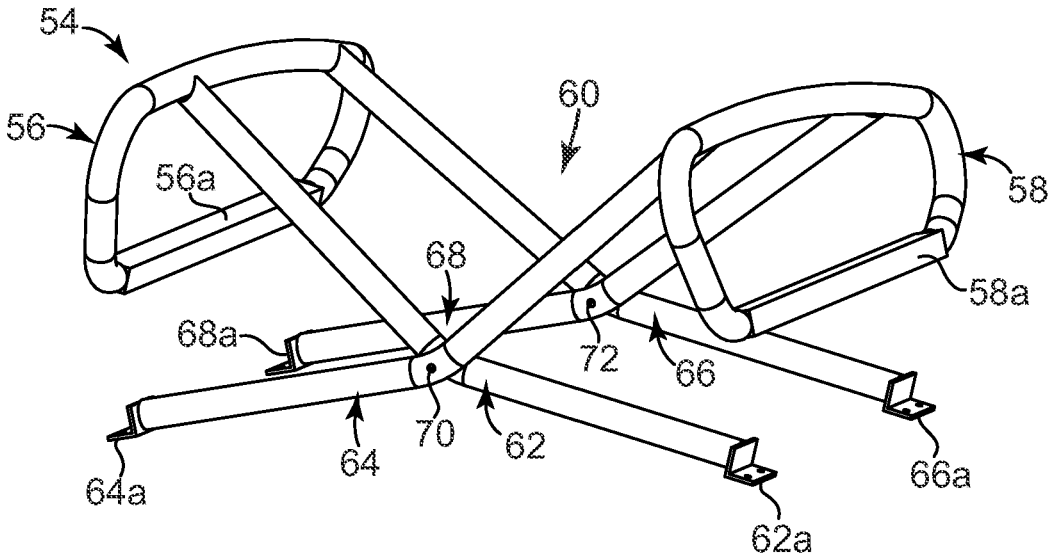
FIG. 8 illustrates a partially folded frame in accordance with one embodiment.

FIG. 8 illustrates a frame 54 in accordance with one embodiment. A cover formed into a three-dimensional envelope, such as cover 22 in FIG. 5, can be added over frame 54 to form a seat such as base 20. In one example, frame 54 includes first and second contours 56 and 58 and spread mechanism 60. Contours 56 and 58 are two opposing forms that are spread and rigidly supported by spread mechanism 60 in order to define and tension the envelope cover that is placed over frame 54.

First and second contours 56 and 58 respectively include first and second connectors 56*a* and 58*b*. Spread mechanism 60 includes first, second, third and fourth legs 62, 64, 66 and 68. First and second legs 62 and 64 are coupled at first pivot 70 and third and fourth legs 66 and 68 are coupled at second pivot 72. In one example, pivots 70 and 72 are bolts secured respectively through first and second legs 62 and 64 and through third and fourth legs 66 and 68.

In one example, each of first through fourth legs 62, 64, 66 and 68 have respective first through fourth couplers 62*a*, 64*a*, 66*a*, and 68*a* at an end. First and third couplers 62*a* and 66*a* are configured to couple to second connector 58*a* and second and fourth couplers 64*a* and 68*a* are configured to couple to first connector 56*a*. An opposite end of each of legs 62, 64, 66 and 68 to couplers 62*a*, 64*a*, 66*a*, and 68*a* is then coupled to contours 56 and 58. Specifically, one end of first and third legs 62 and 66 is coupled to first contour 56 and one end of second and fourth legs 64 and 68 is coupled to second contour 58.

Spread mechanism 60 is configured as a scissors mechanism that can retract and expand first and second contours 56 and 58 as first and second legs 62 and 64 pivot about first pivot 70 and as third and fourth legs 66 and 68 pivot about second pivot 72. In one embodiment, each of legs 62, 64, 66 and 68 have an angle bend relative to pivots 70 and 72. As such, first and third legs 62 and 66 are coupled to a top portion of first contour 56 and second and fourth legs 64 and 68 are coupled to a top portion of second contour 58, while couplers first and third couplers 62*a* and 66*a* are coupled to second connector 58*a* and second and fourth couplers 64*a* and 68*a* are coupled to first connector 56*a*. Because of the angle bend in each of first through fourth legs 62, 64, 66 and 68, a portion of each of first through fourth legs 62, 64, 66 and 68 and both pivots 70 and 72 lie in the bottom plane of frame 54 when frame 54 is fully expanded, similar to the embodiment illustrated in FIG. 4.

In one embodiment, a cover formed into an envelope, such as cover 22 in FIG. 5, can be added over first and second contours 56 and 58 while frame 54 is in the retracted position illustrated in FIG. 8. In one example, edges of the cover envelope can be coupled to connectors 56*a* and 58*a*. Then, first and third couplers 62*a* and 66*a* can pinch the edges of the cover envelope against second connector 58*a*, and second and fourth couplers 64*a* and 68*a* can pinch the edges of the cover envelope against first connector 56*a*. When frame 54 is fully expanded, first and second contours 56 and 58 tension the entire envelope of the cover, which is further secured in place by being pinched between couplers 62*a*, 64*a*, 66*a*, and 68*a* and connectors 56*a* and 58*b*.

Spread mechanism 60 illustrates one way that first and second contours 56 and 58 can be expanded and rigidly supported within a three-dimensional envelope cover to place the entire envelope under tension, thereby forming the simulated cushion usable as an element of furniture, such as base 20 or back 16 (in FIGS. 1-2). Other means of expanding and rigidly supporting opposing contours to place an envelope under tension to form furniture pieces are also possible.

Figure 9:
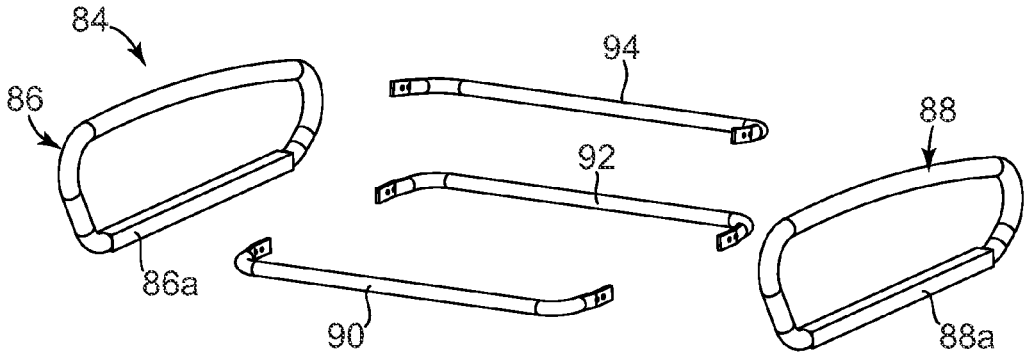
FIG. 9 illustrates an exploded view of a frame in accordance with one embodiment.

FIG. 9 illustrates frame 84 in accordance with one embodiment. In one example, frame 84 includes first and second contours 86 and 88, and first through third legs 90, 92 and 94. First and second contours 86 and 88 can also be configured with first and second connectors 86*a* and 88*a*, which can be used to secure a cover as described above.

In one embodiment, first and second contours 86 and 88 can be placed within a three-dimensional envelope cover, such as cover 22 in FIGS. 3-5. Once inside the cover, first and second contours 86 and 88 can then be spread apart so that they are opposed to each other within the cover placing the entire cover under tension. Then, first through third legs 90, 92 and 94 can be rigidly secured between first and second contours 86 and 88 to so that tension is maintained across all the surfaces of the three-dimensional envelope cover to form a simulated cushion.

In one example, first and second contours 86 and 88 can be placed in a holding mechanism or rack that will allow the three-dimensional envelope cover to be placed over them, and then will spread first and second contours 86 and 88 apart, thereby placing the entire cover under tension. The holding mechanism can be configured to allow access so that first through third legs 90, 92 and 94 can be rigidly secured between first and second contours 86 and 88. Once first through third legs 90, 92 and 94 are rigidly secured, the holding mechanism can release frame 84 so that tension is maintained across all the surfaces of the three-dimensional envelope cover to form a simulated cushion.

Figure 10:
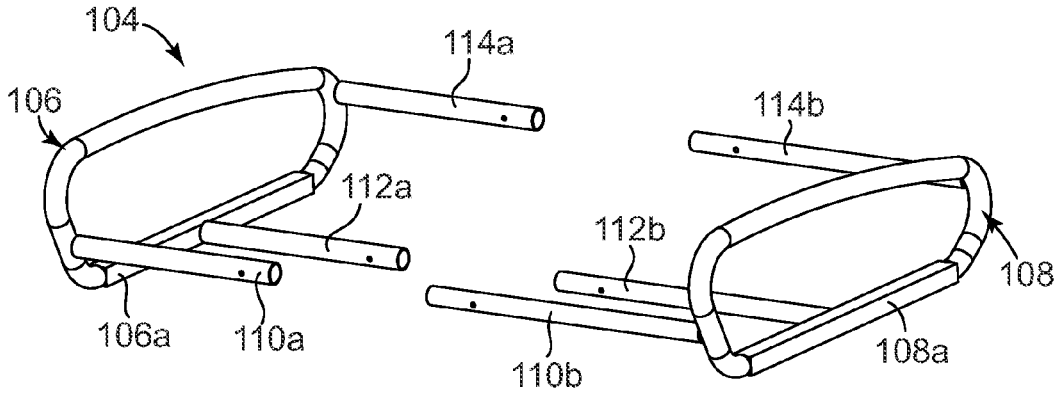
FIG. 10 illustrates an exploded view of a frame in accordance with one embodiment.

First through third legs 90, 92 and 94 can be rigidly secured between first and second contours 86 and 88 with any of a variety of ways. For example, they can be bolted, screwed or rivited to contours 86 and 88. The attachment needs to be rigid and secure in order to maintain tension across all the surfaces of the three-dimensional envelope cover in order to form the simulated cushion FIG. 10 illustrates frame 104 in accordance with one embodiment. In one example, frame 104 includes first and second contours 106 and 108, and first portion of first leg 110*a*, first portion of second leg 112*a*, first portion of third leg 114*a*, second portion of first leg 110*b*, second portion of second leg 112*b*, and second portion of third leg 114*b*. First and second contours 106 and 108 can also be configured with first and second connectors 106*a* and 108*a*, which can be used to secure a cover as described above.

In one embodiment, first and second contours 106 and 108 can be placed within a three-dimensional envelope cover, such as cover 22 in FIGS. 3-5. Also, the second portions of first-third legs 110*b*, 112*b* and 114*b* are configured to slide inside first portions of first-third legs 110*a*, 112*a* and 114*a*. Then, once inside the cover, first and second contours 106 and 108 can then be spread apart so that they are opposed to each other within the cover placing the entire cover under tension. First and second portions of first-third legs 110*a* and *b*, 112*a* and *b* and 114*a* and *b* are configured with holes or slots that will align once first and second contours 106 and 108 are spread apart such that the cover is tensioned. Then, a bolt or other fixing device can be slid into the holes or slot to secure each of first portions of first-third legs 110*a*, 112*a* and 114*a* to second portions of first-third legs 110*b*, 112*b* and 114*b* so that tension is maintained across all the surfaces of the three-dimensional envelope cover to form a simulated cushion.

Figure 11:
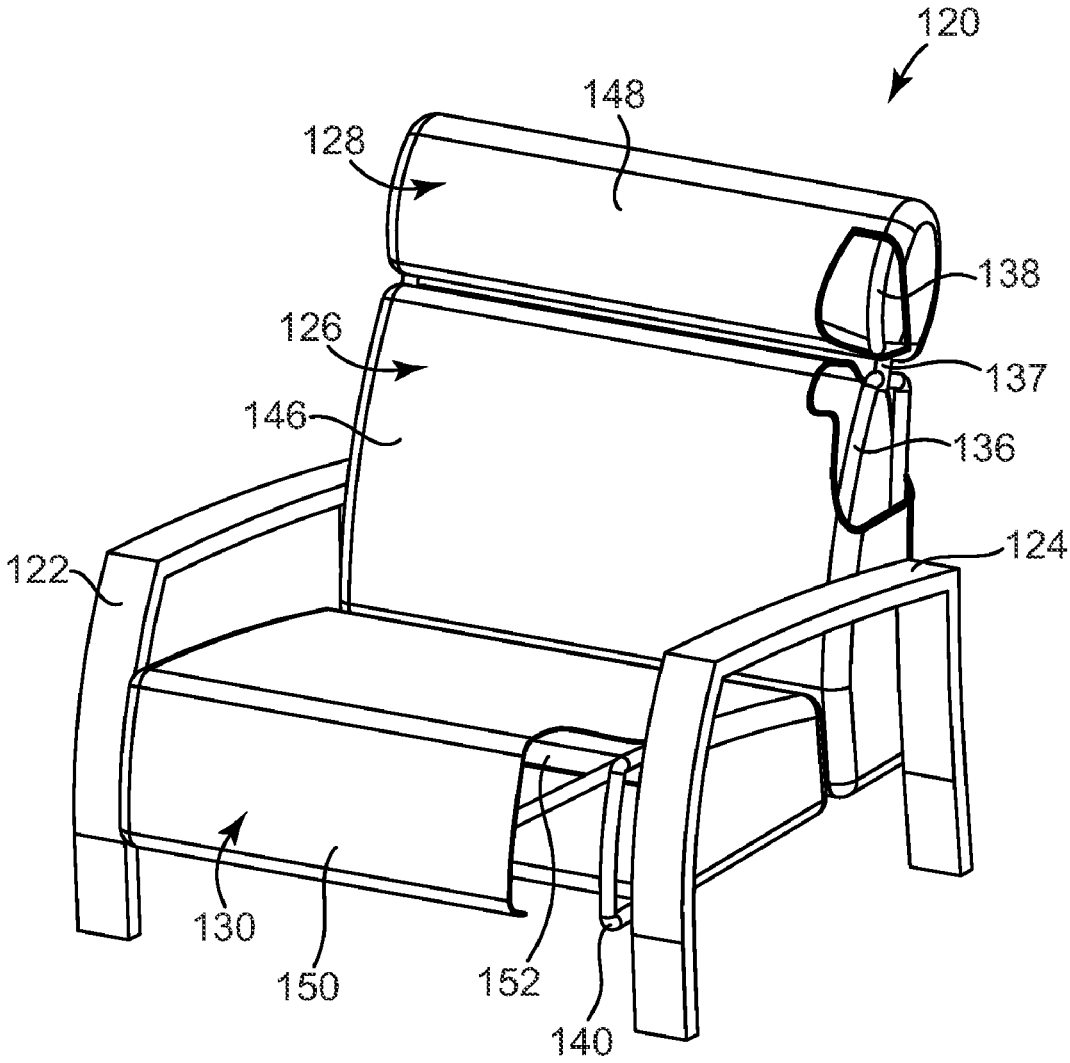
FIG. 11 illustrates a perspective view of a three-dimensional chair, including partial cut-away portions, according to one embodiment.

FIG. 11 illustrates chair 120 in accordance with one embodiment. Chair 120 includes first support 122, second support 124, chair back 126, chair head rest 128 and chair base 130. In one embodiment, each of chair back 126, chair head rest 128, and chair base 130 are coupled between, and supported by, first and second supports 122 and 124. For example, one side of each chair back 126 and chair base 130 (the left sides as illustrated) is fixed to first support 122, and one side of each chair back 126 and chair base 130 (the right sides as illustrated) is fixed to second support 124. In this way, chair back 126 and chair base 130 are supported vertically upward from the ground on which first and second supports 122 and 124 are placed.

In one embodiment, chair back 126, chair head rest 128 and chair base 130 are each configured to have a three-dimensional or upholstered shape, but are not filled with foam or other cushion material. As such, chair 120 can function well as casual outdoor furniture that easily sheds water without excess water retention, because each of its elements chair back 126, chair head rest 128 and chair base 130 remain unfilled so that it does not use foam or cushion material to form and maintain the three-dimensional shape of chair back 126, chair head rest 128 and chair base 130.

In one embodiment, chair 120 chair back 126, chair head rest 128 and chair base 130 each include respective back frame 136, head rest frame 138 and base frame 140 that are each respectively covered by back cover 146, head rest cover 148 and base cover 150. In FIG. 11, back, head rest and base covers 146, 148 and 150 are partially cut away to illustrate portions of back frame 136, head rest frame 148 and base frame 140. In one case, it is the cooperation of first and second supports 122 and 124 and back frame 136, head rest frame 138 and base frame 140 that place all of covers 146, 148 and 150 under tension.

For example, as with the illustrations of FIGS. 9 and 10, base frame 140 can include first and second contours that are placed within the three-dimensional fabric envelope of base cover 150. Then, one of first and second contours can be fixed to one of first and second supports 122 and 124, while the other of the first and second contours can be fixed to the other of first and second supports 122 and 124. Next, first and second supports 122 and 124 can be forced apart, thereby placing base cover 150 under tension. A brace or a plurality of braces can then be rigidly fixed between first and second supports 122 and 124 to hold the volume of base cover 150 under tension creating a simulated cushion suitable for seating.

In one example, after first and second contours of base frame 140 have been fixed to first and second supports 122 and 124, first and second supports 122 and 124 can be forced apart by a rack or other holding mechanism such that base cover 150 is held under tension. Then, brace 152, and similar braces, can be rigidly secured between first and second supports 122 and 124. Once brace 152 is in place, the rack or holding mechanism can be removed, since brace 152 will rigidly hold first and second supports 122 and 124 apart thereby holding base cover 150 under tension creating the simulated cushion.

Braces, such as brace 152, can be secured between first and second supports 122 and 124 in any of a variety of ways. For example, they could be bolted or screwed, they could be rivited or any a variety of other means of fastening. In embodiments, brace 152 could be part of base frame 140, or it can be separate and independent from base frame 140. Similar such braces can be used to construct seat back 126 and head rest 128.

In one embodiment, head rest frame 138 is not coupled between first and second supports 122 and 124, and rather, is coupled to seat back frame 136 via frame coupler 137. First and second contours of head rest frame 138 can be moved apart as above, and then secured in that spread position with braces between them in order to tension the volume of head rest cover 148.

Figure 12:
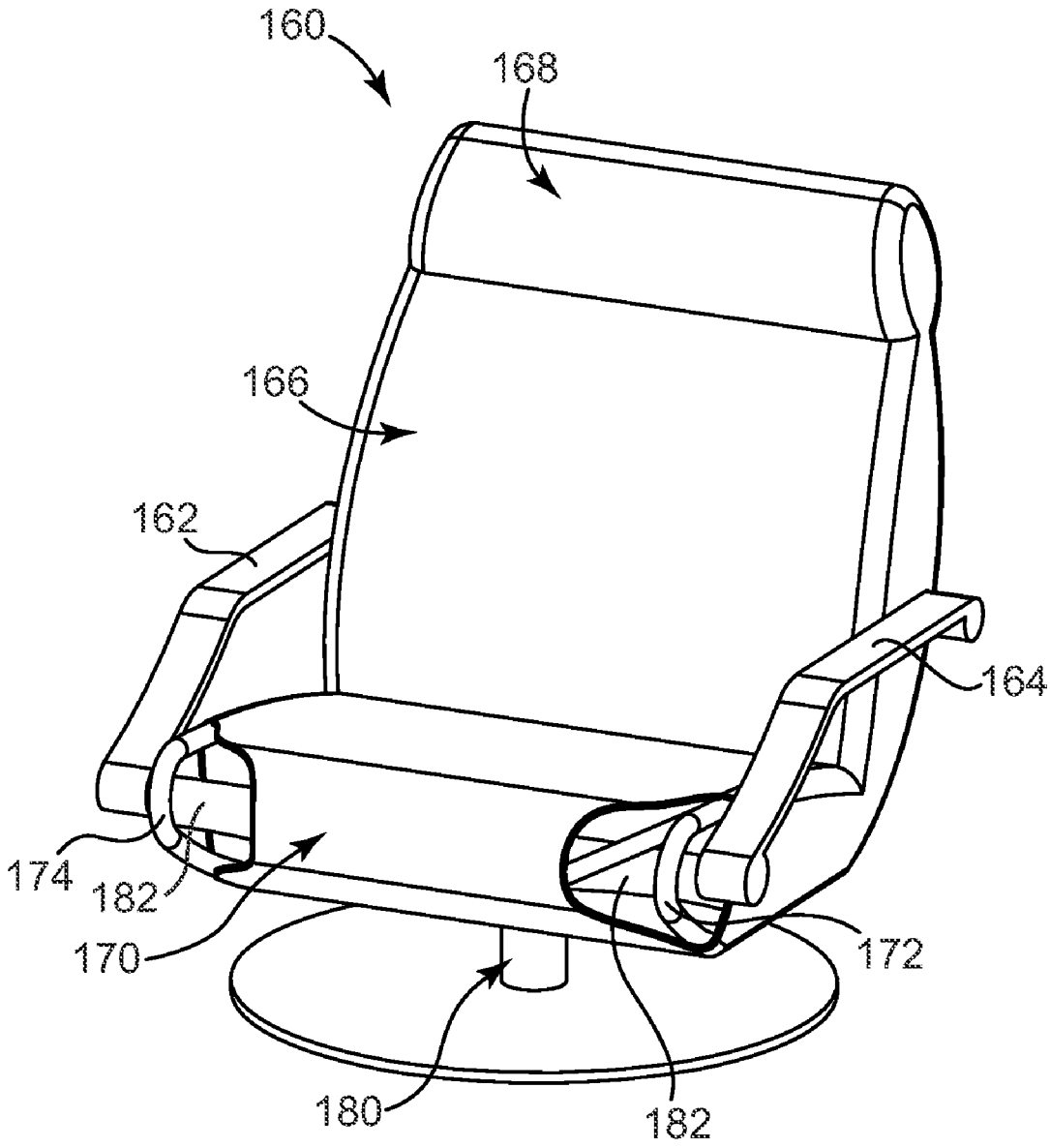
FIG. 12 illustrates a perspective view of a three-dimensional chair, including partial cut-away portions, according to one embodiment.

FIG. 12 chair 160 in accordance with one embodiment. Chair 160 includes first support 162, second support 164, chair back 166, chair head rest 168 and chair base 170. In one embodiment, each of chair back 166, chair head rest 168, and chair base 170 are integrally formed with a first contour 172 that runs along one side of chair 160 (the right side as illustrated in FIG. 12) and a second contour 174 that runs along an opposite side of chair 160 (the left side as illustrated in FIG. 12).

As such, unlike the previous embodiment illustrated in FIG. 11, chair 160 is configured with a single first contour 172 and a single second contour 174 that each spans the entire side of chair 160 to define the shape of all three sections of chair 160: chair back 166, chair head rest 168 and chair base 170. In one case, chair back 166, chair head rest 168 and chair base 170 can include a single cover, which is placed over first and second contours 172 and 174. Then, first contour 172 can be fixed to first support 162, while second contour 174 can be fixed to second support 164. Next, first and second supports 172 and 174 can be forced apart, thereby placing the entire cover under tension. A brace or a plurality of braces can then be rigidly fixed between first and second supports 172 and 174 to hold the volume of the cover of chair 160 under tension creating a simulated cushion suitable for seating.

In one embodiment, a brace 182 is rigidly fixed between first and second supports 172 and 174 to hold the volume of the cover of chair 160 under tension. Another brace could also be rigidly fixed between first and second supports 172 and 174 at an opposite end, such that it extends behind chair back 166. By tensioning and securely holding apart first and second supports 172 and 174, and first and second contours 172 and 174 that are attached to them, the entire volume of the cover of chair 160 remains under tension creating a simulated cushion suitable for seating.

Figure 13:
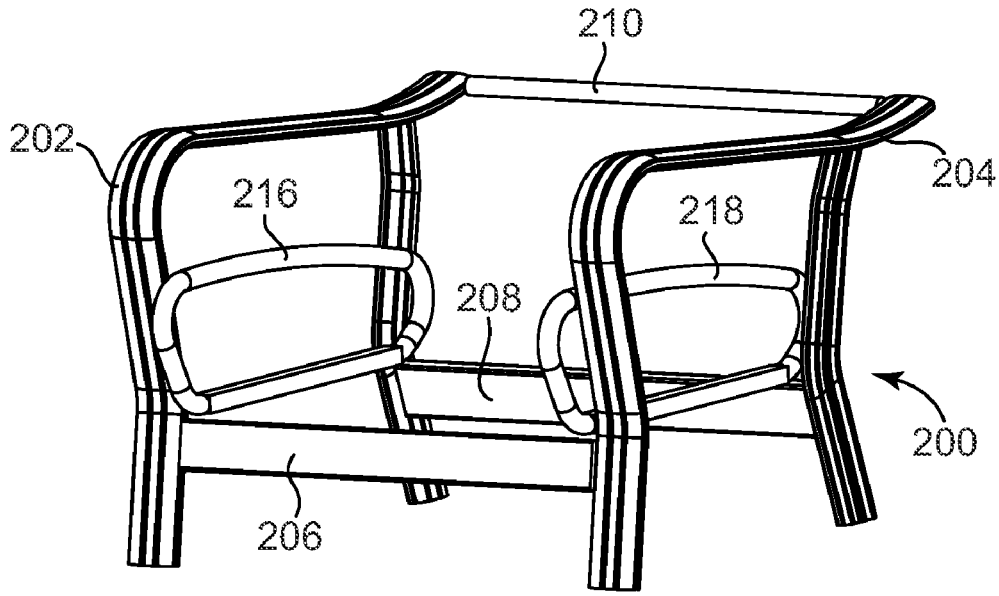
FIG. 13 illustrates a perspective view of a partially assembled three-dimensional chair according to one embodiment.
Figure 14:
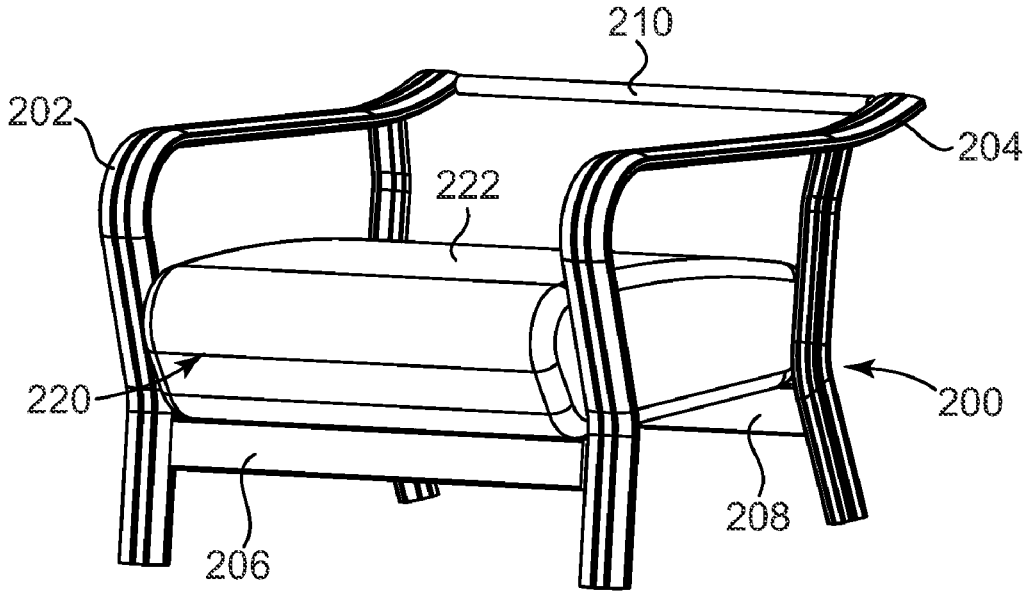
FIG. 14 illustrates a perspective view of a three-dimensional chair according to one embodiment.

FIGS. 13 and 14 illustrate chair 200 in accordance with one embodiment. Chair 200 includes first support 202, second support 204, first, second and third braces 206, 208, and 210, and chair base 220 (illustrated in FIG. 14). In one embodiment, chair base 220 includes cover 222, first contour 216 and second contour 218. First and second contours are fitted within cover 222, which is then fully tensioned to create the simulated cushion of base 220. In the example, tension is applied and held on cover 222 by the cooperation of first and second contours 216 and 218, first and second supports 202 and 204, and first, second and third braces 206, 208, and 210.

In one embodiment, cover 222 is placed over first and second contours 216 and 218. Then, first contour 216 is fixed to first support 202 and second contour 218 is fixed to second support 204. Next, first and second supports 202 and 204 can be forced apart by a rack or other holding mechanism such that cover 222 is held under tension. Then, first, second and third braces 206, 208, and 210 can be rigidly secured between first and second supports 202 and 204. Once first, second and third braces 206, 208, and 210 are in place, the rack or holding mechanism can be removed, since braces 206-210 will rigidly hold first and second supports 202 and 204 apart, thereby holding cover 222 under tension creating the simulated cushion.

As is illustrated in this example, only the first and second contours 216 and 218 are placed inside cover 222, and tension is applied and held on cover 222 by the cooperation of elements outside cover 222. In this way, by coupling first and second contours 216 and 218 to first and second supports 202 and 204, and then forcing supports 202 and 204 apart with first, second and third braces 206, 208, and 210, a tension is placed on all panels on cover 222.

As with cover 22 above, cover 222 can be a fabric material that is sewn into a three-dimensional shape having two sides, a front, a back and a top. In one example, cover 222 is symmetrical about a mid-plane that runs vertically on the page dividing base 220 in half. A single piece of fabric can be used to form front, top and back surfaces, while the two side surfaces are then sewn to either side of this single piece of fabric. These five surfaces or panels form the three-dimensional shape of cover 222 that are all tensioned to form the simulated cushion.

In one embodiment, first brace 206 is fixed between first and second supports 202 and 204 at the front of chair 200 just below base 220, second brace 208 is fixed between first and second supports 202 and 204 at the back of chair 200 just below base 220, and third brace 210 is fixed between first and second supports 202 and 204 at the back, and toward the top, of chair 200. Braces 206-210 can be bolted, screwed or welded between first and second supports 202 and 204. Locating braces 206-210 at these three different locations can help provide good stability to chair 200 and help keep good tension on cover 222 so that all panels are tensioned to form the simulated cushion.

Although specific embodiments have been illustrated and described herein, it will be appreciated by those of ordinary skill in the art that a variety of alternate and/or equivalent implementations may be substituted for the specific embodiments shown and described without departing from the scope of the present invention. For example, FIG. 1 illustrates a chair, but one skilled in the art will recognize that a frame, with contours and spread mechanism, can be configured to be covered with a cover that is tensioned and suitable for a couch, lounge chair or any number of configurations. This application is intended to cover any adaptations or variations of the specific embodiments discussed herein. Therefore, it is intended that this invention be limited only by the claims and the equivalents thereof.

What is claimed is:

1. A furniture piece configured for seating, the furniture piece comprising:

first and second contours;

a spreader mechanism coupled between the first and second contours; and a cover having a plurality of panels shaped into a three-dimensional volume;

wherein the cover is over the first and second contours and the spreader mechanism thereby surrounding the contours and spreader mechanism, and such that the cover is tensioned by the contours and spreader mechanism in each of its panels thereby creating a simulated cushion;

wherein the cover is a fabric material that is sewn into the three-dimensional volume having a front, a back, two sides and a top; and wherein the three-dimensional volume of the cover completely contains the first and second contours and the spreader mechanism such that no portion of the contours or spreader mechanism extend outside the front, back, sides or top of the cover.

2. The furniture piece of claim 1, wherein the front, back and top of the cover comprise a single piece of fabric and the first and second sides of the cover are sewn to first and second sides of the single piece of fabric to form the three-dimensional volume.

3. The furniture piece of claim 2, wherein the first and second contours engage the two sides of the cover.

4. The furniture piece of claim 3, wherein the first and second contours are covered with a wrap thereby softening edges of the simulated cushion.

5. The furniture piece of claim 4, wherein the spreader mechanism comprises a scissors mechanism with a first leg and a second leg coupled between the first and second contours and pivotally coupled to each other such that pivoting the first leg relative to the second leg spreads the first and second contours and holds them rigidly apart, thereby tensioning the three-dimensional volume of the cover.

6. The furniture piece of claim 5, wherein the first and second legs of the spreader mechanism pivot about a point that is in a plane of the bottom of the three-dimensional volume.

7. The furniture piece of claim 1, wherein the three-dimensional volume of the cover further includes a bottom panel such that the cover completely contains the first and second contours and the spreader mechanism such that no portion of the contours or spreader mechanism are visible outside the cover.

8. The furniture piece of claim 1, wherein the simulated cushion is configured to support a user's weight.

9. The furniture piece of claim 8 further comprising first and second supports coupled on either side of the simulated cushion, thereby providing support for the simulated cushion vertically displaced from the ground.

10. The furniture piece of claim 9 wherein the first and second supports are independent from the spreader mechanism and from the first and second contours.

11. A furniture piece configured for seating, the furniture piece comprising:

a three-dimensional fabric envelope having a front panel, a back panel, first and second side panels, and a top panel; and a frame contained within the fabric envelope, the frame comprising first and second contours and a spreader mechanism coupled between the first and second contours;

wherein the first and second contours engage at least two panels and the spreader mechanism forces the first and second contours apart such that the fabric envelope is tensioned in each of the front panel, the back panel, the first and second side panels, and the top panel, thereby creating a three-dimensional seating structure that is usable for seating; and wherein the three-dimensional fabric envelope completely contains the frame such that no portion of it extends outside the front panel, the back panel, the first and second side panels, or the top panel.

12. The furniture piece of claim 11, wherein the spreader mechanism comprises a scissors mechanism with a first leg and a second leg coupled between the first and second contours and pivotally coupled to each other such that pivoting the first leg relative to the second leg spreads the first and second contours thereby tensioning the fabric envelope.

13. The furniture piece of claim 12, wherein the spreader mechanism is reversible such that the three-dimensional fabric envelope can be easily placed over the frame when the frame is retracted and such that the three-dimensional fabric envelope can be easily tensioned over the frame when the frame is fully expanded.

14. The furniture piece of claim 11 further comprising first and second supports coupled on either side of the frame, thereby providing support for the seating structure configured to support a user's weight at a location that is vertically displaced from the ground.

15. The furniture piece of claim 14, wherein the first and second supports are independent from the frame.

16. The furniture piece of claim 11, wherein the first side panel is sewn to one side of the front panel, the back panel, and the top panel and the second side panel is sewn to an opposite side of the front panel, the back panel, and the top panel, thereby forming the three-dimensional fabric envelope that is tensioned.

17. The furniture piece of claim 11, wherein the first and second contours are covered with a wrap thereby softening edges of the simulated cushion.

18. A furniture piece configured for seating, the furniture piece comprising:

first and second supports; and a back and a base configured between and supported by the first and second supports, the back comprising a back frame and a back cover and the base comprising a base frame and a base cover;

wherein the back cover is a three-dimensional fabric envelope having a front panel, a back panel, first and second side panels, and a top panel, the back cover sewn together to surround the back frame such that the back cover is tensioned in each of the front panel, the back panel, the first and second side panels, and the top panel, thereby creating a three-dimensional back structure that is usable for seating;

wherein the base cover is a three-dimensional fabric envelope having a front panel, a back panel, first and second side panels, and a top panel, the base cover sewn together to surround the base frame such that the base cover is tensioned in each of the front panel, the back panel, the first and second side panels, and the top panel, thereby creating a three-dimensional base structure that is usable for seating; and wherein, for at least one of the back and base covers, the three-dimensional fabric envelope completely contains the frame such that no portion of it extends outside the front panel, the back panel, the first and second side panels, or the top panel.

19. The furniture piece of claim 18, wherein the back frame comprises a back spreader mechanism coupled between first and second back contours, and wherein the base frame comprises a base spreader mechanism coupled between first and second base contours.

20. The furniture piece of claim 19, wherein at least some of the base and back contours are covered with a wrap thereby softening edges of the base and back.

21. A method of assembling a furniture piece comprising:

retracting a frame comprising first and second contours and a spreader mechanism;

placing a fabric envelope having a front panel, a back panel, first and second side panels, and a top panel, over the retracted frame such that the first and second side panels engage the first and second contours;

expanding the frame within the fabric envelope such that the spreader mechanism forces the first and second contours apart such that the fabric envelope is tensioned in each of the front panel, the back panel, the first and second sidepanels thereby creating a simulated cushion, and such that the spreader mechanism and the first and second contours are contained completely within the fabric envelope.

22. The method of claim 21 further comprising retracting the frame and removing the fabric envelope from the retracted frame.

23. The method of claim 21 farther comprising assembling first and second supports on the frame providing support for the simulated cushion at a location that is vertically displaced from the ground.

24. A furniture piece configured for seating, the furniture piece comprising:

a first support;

a first contour coupled to the first support;

a second support spaced apart from the first support;

a second contour coupled to the second support;

a cover envelope having a three-dimensional volume and configured over the first and second contours thereby completely containing them; and a first brace coupled between the first and second supports such that the brace securely holds the first and second supports and the first and second contours apart thereby tensioning the entire volume of the cover envelope so that the cover envelope forms a simulated cushion;

wherein the first and second supports and the first brace are all outside the cover envelope and wherein the first and second supports are each respectively coupled to the first and second contours through the cover envelope.

25. The furniture piece of claim 24, wherein the first and second contours and cover envelope are configured such that the cover envelope comprises a seat base section, a seat back section and a head rest section.

26. The furniture piece of claim 24 further comprising second and third braces coupled between the first and second supports such that the first, second and third braces securely hold the first and second supports and the first and second contours apart thereby tensioning the entire volume of the cover envelope so that the cover envelope forms a simulated cushion.

27. The furniture piece of claim 26, wherein the first brace is coupled across a front portion of the furniture piece, the second brace is coupled across a back portion of the furniture piece, and the third brace is coupled at a third location different than the first and second braces, thereby providing good stability and tension across the cover envelope.

* * * * *